United States Patent [19]

Wolowicz

[11] 4,422,711

[45] Dec. 27, 1983

[54] ACTIVE PIN CONTACT

[75] Inventor: James P. Wolowicz, Harrisburg, Pa.

[73] Assignee: AMP Incorporated, Harrisburg, Pa.

[21] Appl. No.: 333,231

[22] Filed: Dec. 21, 1981

[51] Int. Cl.[3] ..... H01R 11/22

[52] U.S. Cl. ..... 339/252 R

[58] Field of Search ..... 339/217 J, 252 R, 252 P, 339/252 S

[56] References Cited

U.S. PATENT DOCUMENTS

| | | | |
|---|---|---|---|
| Re. 26,721 | 11/1969 | Shlesinger | 339/217 J |
| 1,387,252 | 8/1921 | Fredricks | 339/217 J |
| 2,690,546 | 9/1954 | Ostrak | 339/252 |
| 3,178,676 | 4/1965 | Antes | 339/252 |
| 3,358,265 | 12/1967 | Robards | 339/252 P |
| 3,617,991 | 11/1971 | Shlesinger | 339/217 J |
| 3,766,516 | 10/1973 | Appleton | 339/252 P |

*Primary Examiner*—Joseph H. McGlynn
*Assistant Examiner*—Paula Austin
*Attorney, Agent, or Firm*—Adrian J. LaRue

[57] ABSTRACT

An active electrical pin contact comprises a hollow pin contact section having a longitudinal seam extending from one end to the other and including opposed recessed areas defining a longitudinal slot. A spring member is disposed in the hollow pin contact section and it includes a linear section, a bowed section, and a front arcuate section. The linear section and the front arcuate section extend along an inside surface of the hollow pin contact section and the bowed section is disposed in the longitudinal slot including a contact-engaging section extending outwardly beyond an outside surface of the hollow pin contact section.

7 Claims, 6 Drawing Figures

74
94
90
96
84
86
80
92
88
82
76
78
36
22
52
42
16
40
32
54
34
56
58
46
38
26
66
68
64
60
24
62
18
48
70
50
72

90
94
96
86
84
82
88
22
74
80
32
42
76
40
16
78
36
52
34
38
54
46
68
58
26
66
64
24
60
62
48
18
70
72
50

ACTIVE PIN CONTACT

FIELD OF THE INVENTION

This invention relates to electrical contacts and more particularly to active pin contacts for electrical connection with socket contacts.

BACKGROUND OF THE INVENTION

Electrical connectors using matable pins and sockets have been extensively used. These electrical connectors are typically high density whereby a large number of matable pins and sockets are mounted in connector housings of the electrical connectors and electrical connection is effected by matable engagement between the pins and sockets and their respective housings. In this connection, the integrity of the electrical connection between the respective matable pins and sockets and the forces of insertion of the pins within the sockets during mating engagement are important factors to assure effective electrical connections. Use of active pin contacts can assure such effective electrical connections when matably connected with respective socket contacts.

SUMMARY OF THE INVENTION

According to the present invention, an active electrical pin contact comprises a hollow pin contact section having a longitudinal seam extending from one end to the other and including opposed recessed areas defining a longitudinal slot. A spring member is disposed in the hollow pin contact section and it includes a linear section, a bowed section, and a front arcuate section. The linear section and the front arcuate section extend along an inside surface of the hollow pin contact section and the bowed section is disposed in the longitudinal slot including a contact-engaging section extending outwardly beyond an outside surface of the hollow pin contact section.

According to another aspect of the present invention, the linear section of the spring member is anchored against the inside surface of the hollow pin contact section permitting the front arcuate section to move along the inside surface when an inward force is exerted on the contact-engaging section.

DETAILED DESCRIPTION OF PREFERRED EMBODIMENTS

Figure 1:
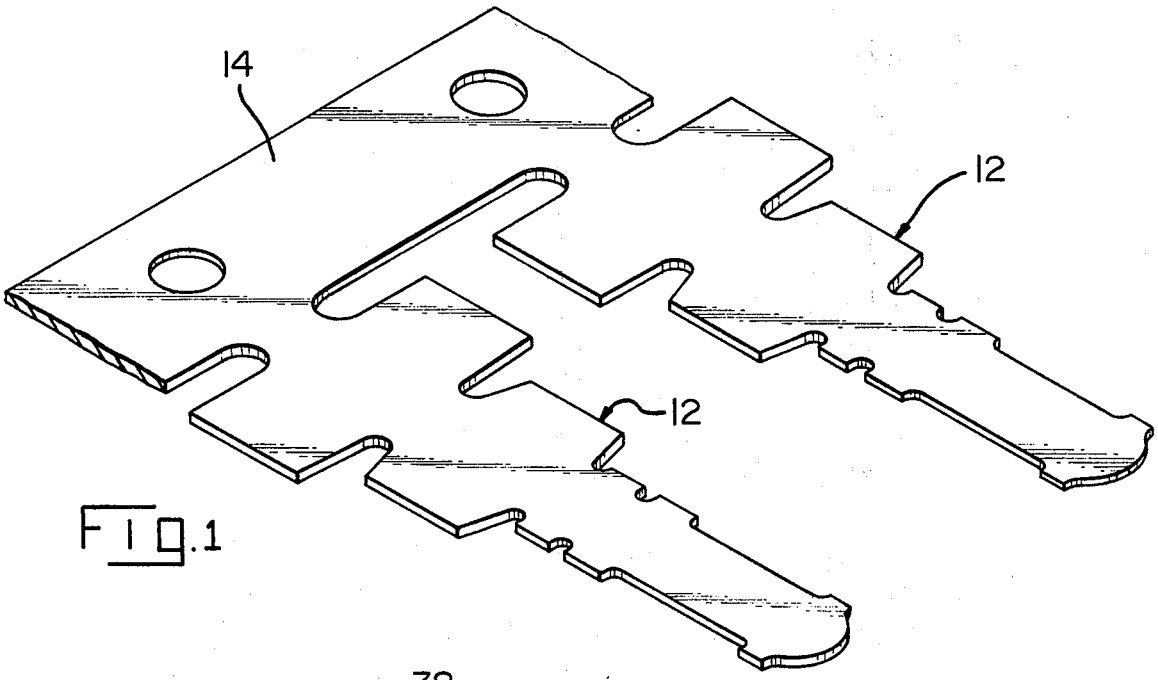
FIG. 1 is a perspective view of blanks of an active pin contact prior to being formed into active pin contacts.
Figure 2:
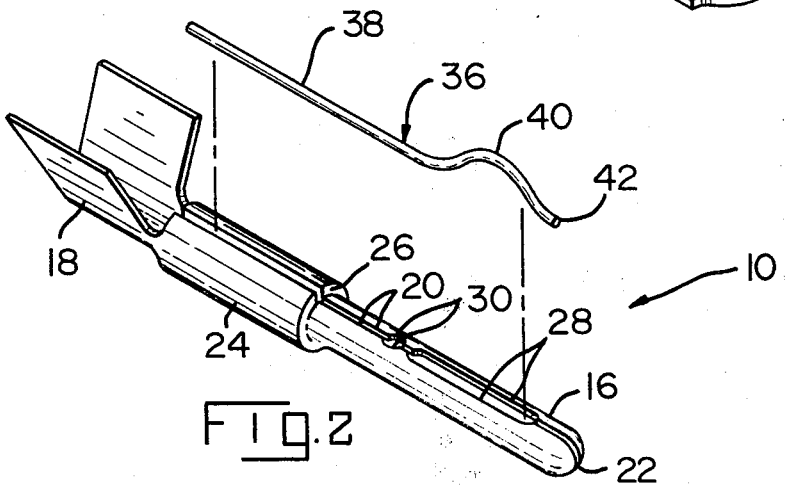
FIG. 2 is a perspective view of a partly-formed active pin contact with a spring member exploded therefrom.
Figure 3:
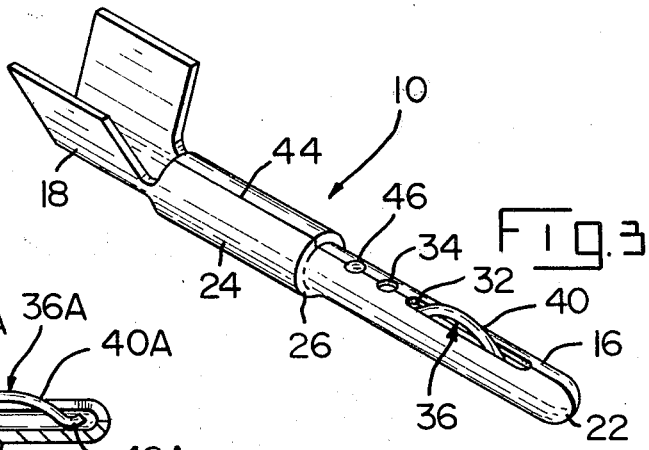
FIG. 3 is a view similar to FIG. 2 showing a completely-formed active pin contact.

FIGS. 1–3 illustrate the various stages of manufacture of active pin contact 10 wherein FIG. 1 illustrates blanks 12 on carrier strip 14 which have been stamped from a suitable metal strip such as brass or the like. Blanks 12 outline the pine contact prior to being partly formed as illustrated in FIG. 2 wherein the active pin contact includes a pin contact section 16 and a conductor-connecting section 18. Edges 20 of pin contact section 16 are spaced from each other as illustrated in FIG. 2 thereby forming a longitudinal gap extending from the rounded nose portion 22, along pin contact section 16 and along stop section 24. Stop section 24 has a larger diameter than pin contact section 16 and a stop surface 26 is located at the intersection of pin contact section 16 and stop section 24.

Opposed recessed areas 28 and opposed arcuate areas 30 are located in edges 20 and they form respectively a longitudinal slot 32 and a hole 34 when pin contact 10 is in its completely-formed condition as illustrated in FIG. 3.

After blanks 12 have been partly formed as shown in FIG. 2 and with the partly-formed pins still connected to carrier strip 14, they are gold plated.

A spring member 36 is formed from a stainless steel wire and includes a linear section 38, a bowed section 40, and a front arcuate section 42.

Figure 4:
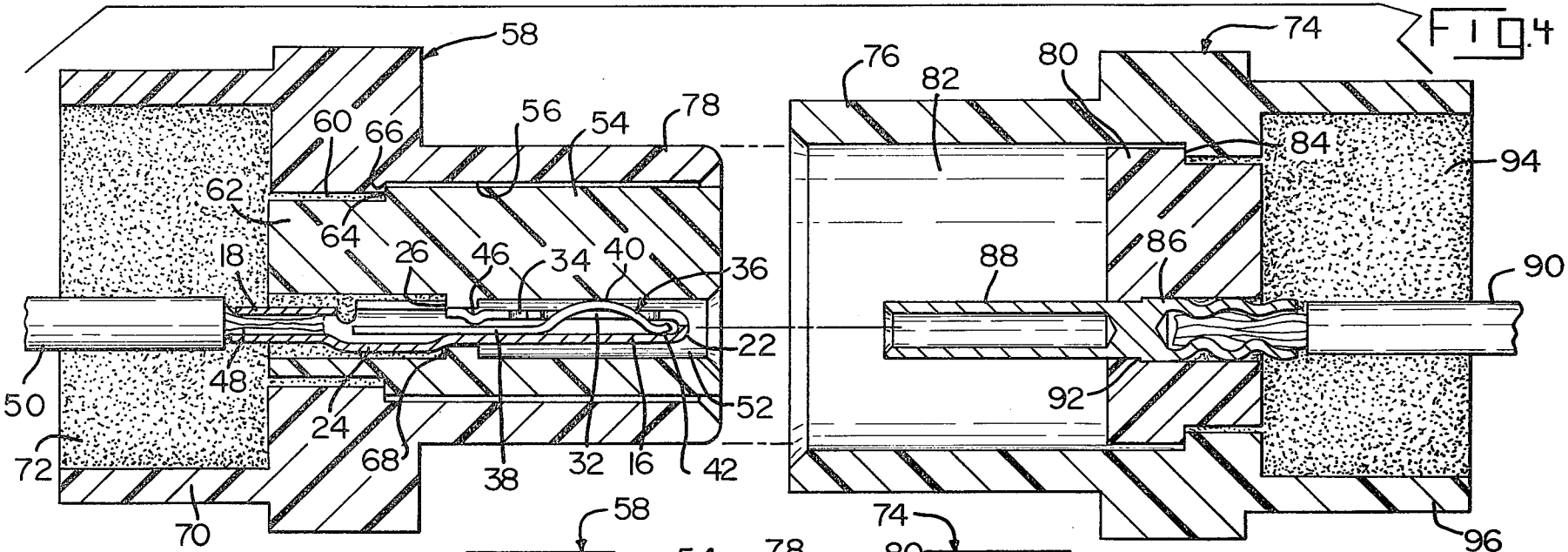
FIG. 4 is a cross-sectional view of matable electrical connector housings and pin and socket contacts therein.
Figure 5:
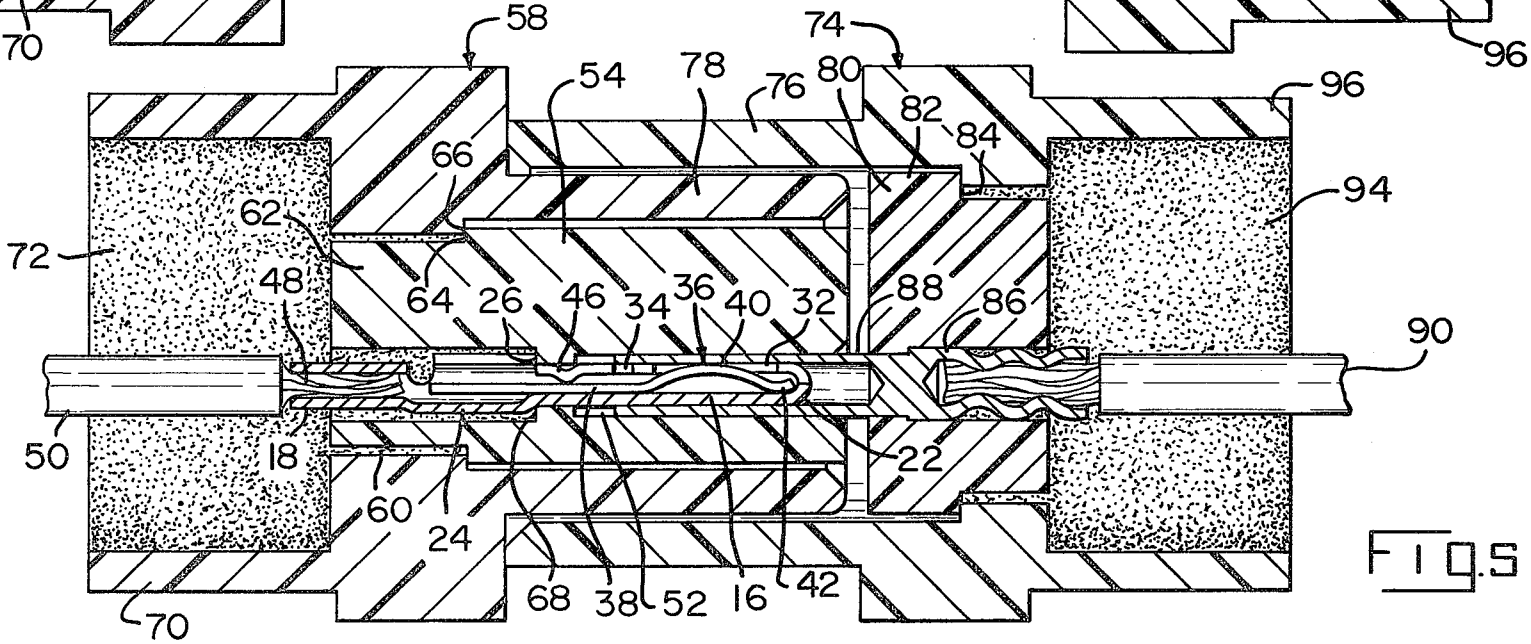
FIG. 5 is a view similar to FIG. 4 showing the connector housings and pin and socket contacts in mated engagement.

As shown in FIG. 2, active pin contact 10 is partly formed with edges 20 spaced from each other to form a gap of sufficient width to enable spring member 36 to be inserted therethrough within hollow pin contact section 16 and stop section 24 whereafter pin contact section 16 and stop section 24 are subjected to a final forming operation to form pin contact 10 in its final configuration as illustrated in FIG. 3. During this final forming operation, edges 20 are brought into engagement to form a longitudinal seam extending the length of pin contact section 16 and stop section 24 thereby forming longitudinal slot 32 and hole 34. A dimple 46 is formed in longitudinal seam 44 between hole 34 and stop surface 26 as shown in FIG. 3–5 thereby anchoring linear section 38 of spring member 36 against the inside surface of pin contact section 16. With spring member 36 anchored in position in pin contact section 16, bowed section 40 of spring member 36 is disposed within longitudinal slot 32 and a part of bowed section 40 extends outwardly beyond the outer surface of pin contact section 16 thereby defining a contact-engaging section. Hole 34 defines a relief area to prevent deformation of pin contact section 16 when dimple 46 is formed therein to anchor linear section 38 in position within hollow pin contact section 16.

After active pin contact 10 has been completely formed as illustrated in FIG. 3, conductor 48 of insulated electrical conductor 50 is terminated in conductor-connecting section 18 in accordance with conventional terminating practices. Terminated pin contacts 10 are then inserted into passageways 52 in dielectric contact-carrying member 54 which is secured in an opening 56 of connector housing member 58. Opening 56 has a reduced section 60 in which a corresponding reduced section 62 of contact carrying member 54 is disposed. Stop surfaces 64, 66 of contact carrying member 54 and opening 56 respectively engage one another to limit inner movement of member 54 within opening 56. A stop surface 68 is also located in passageways 52 against which stop surfaces 26 of active pin contacts engage to limit inner movement of pin contacts 10 within passageways 52. A hood section 70 extends outwardly from the rear of housing member 58 and in which commercially-available epoxy material 72 is disposed after pin contacts 10 have been positioned in passageways 52 thereby sealingly securing contact carrying member 54 in position in housing member 58 and pin contacts 10 and corresponding electrical conductors 50 in position in housing member 58.

Connector housing member 74 has a forward hood section 76 that is matable with section 78 of connector housing member 58 in which any major portion of contact carrying member 54 is located and where pin contact sections 16 of active pin contacts 10 are positioned as shown in FIGS. 4 and 5. A dielectric contact carrying member 80 is positioned in opening 82 of housing member 74 which abuts against a stop surface 84 to limit its inward movement. Passageways 86 are located in contact carrying member 80 in alignment with corresponding passageways 52 and socket 88 terminated to electrical conductors of insulated electrical conductors 90 are positioned in passageways 86 against stop surfaces 92 therein to limit inner movement of socket contacts 88 therewithin as shown in FIGS. 4 and 5. Epoxy material 94 similar to that of epoxy material 72 is disposed in rear hood section 96 sealingly securing contact carrying member 80 in position in housing member 74, socket contacts 88 in passageways 86, and surrounding electrical conductors 90. Connector housing members 58, 74 can be made from a suitable insulating material; they can also be made of metal or metal-plated plastic as desired. A projection can be provided on the outer surface or section 78 of housing member 58 or within opening 82 of housing member 74 to provide a seal when the housing members are matably connected together.

Thus, with active pin contacts 10 sealingly secured in position in passageways 52 of housing member 58 and socket contacts 88 sealingly secured in position in housing member 74, housing members 58, 74 can be matably connected together as illustated in FIG. 5 with pin contact sections 16 electrically connected within socket contacts 88. Passageways 52 have a diameter to accommodate socket contacts 88 therein.

As illustrated in FIG. 5, the interconnection of pin contact sections 16 with socket contacts 88 causes the contact-engaging sections of bowed sections 40 of spring members 36 to be engaged by socket contacts 88 which causes pin contact sections 16 to wipingly move along socket contacts 88 by virtue of the spring forces exerted by spring member 36 and front arcuate section 42 moves along the inside surface of hollow pin contact sections 16 to reduce the insertion forces that take place during engagement of pin contact sections 16 within socket contacts 88. The insertion forces can be rather significant as the density of the pin contacts 10 and socket contacts 88 increase. The configuration of spring member 36 and the operational characteristics thereof enables pin contact sections 16 to electrically engage socket contacts 88 in an effective manner and the insertion forces are reduced when interconnection takes place.

Figure 6:
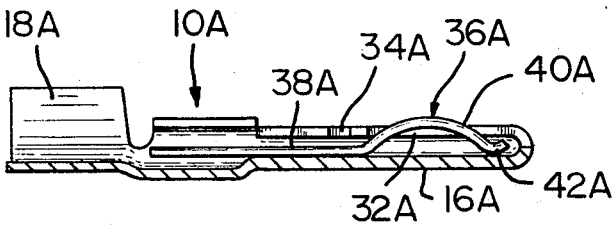
FIG. 6 is a cross-sectional view of an alternative embodiment of an active pin contact.

FIG. 6 illustrates an alternative active pin contact 10A wherein spring member 36A is not captured by means of a dimple so that linear section 38A is freely disposed within hollow pin contact section 16A so that linear section 38A and front arcuate section 42A can both slidably move along the inside surface of hollow pin contact section 16A when force is applied to bowed section 40A extending outwardly beyond the outer surface of pin contact section 16A. Bowed section 40A in longitudinal slot 32A maintains spring member 36A in position in hollow pin contact section 16A. This construction will further reduce the insertion forces when the pin contact sections are interconnected with the socket contacts when the connector housing members are interconnected.

I claim:

1. An active electrical pin contact including a hollow pin contact section and a conductor-connecting section for electrical connection with an electrical conductor, a spring member secured in said pin contact section, characterized in that said hollow pin contact section being partly formed with a rounded nose portion and with edges to be abutted including opposed recessed areas therealong to form a longitudinal slot being spaced a predetermined distance from each other forming a longitudinal gap therealong;

said spring member having a linear section, a bowed section and a short front section which has a curved configuration reverse to that of said bowed section;

said spring member being inserted into said hollow pin contact section through said longitudinal gap with said linear section extending along an inside surface of said hollow pin contact section, said bowed section having a contact-engaging section extending above an outside surface of said hollow pin contact section within the opposed recessed areas and said curved front section extending along said inside surface spaced from an inside curved surface of the partly-formed nose portion;

said hollow pin contact section being formed into its final configuration with said edges in abutment thereby permitting at least said curved front section to move along said inside surface when an inward force is exerted onto said contact-engaging section.

2. An active electrical pin contact as set forth in claim 1 characterized in that a dimple is formed rearwardly of said longitudinal slot securing said linear section in position against said inside surface.

3. An active electrical pin contact as set forth in claim 1 characterized in that said hollow pin contact section includes opposed arcuate recesses in said edges forming a hole to provide a relief area when said dimple is formed.

4. An active electrical pin contact comprising:

a hollow pin contact section and a conductor-connection section, said pin contact section having a longitudinal seam extending from one end to the other and including opposed recessed areas defining a longitudinal slot;

a spring member disposed in said hollow pin contact section including a linear section, a bowed section and a front arcuate section, said linear section and said front arcuate section extending along an inside surface of said hollow pin contact section and said bowed section disposed in said longitudinal slot including a contact-engaging section extending outwardly beyond an outside surface of said hollow pin contact section, said front arcuate section being movable along said inside surface when an inward force is exerted onto said contact-engaging section.

5. An active electrical pin contact as set forth in claim 4 wherein said hollow pin contact section has a rounded nose section.

6. An active electrical pin contact as set forth in claim 4 and further comprising:

a dimple anchoring said linear section in position along said inside surface.

7. An active electrical pin contact as set forth in claim 6 and further comprising:

opposed arcuate areas in said longitudinal seam forming a hole defining a relief area when said dimple is formed.

* * * * *